United States Patent [19]

Constantinescu

[11] 4,344,592

[45] Aug. 17, 1982

[54] LAUNCHING TOWER FOR HEAVY ROCKETS

[76] Inventor: Spiridon Constantinescu, 161 Violet Dr., Stoney Creek, Ontario L8E 3J2, Canada

[21] Appl. No.: 171,240

[22] Filed: Jul. 22, 1980

Related U.S. Application Data

[63] Continuation of Ser. No. 850,227, Nov. 10, 1977, abandoned.

[51] Int. Cl.[3] ..... B64F 1/04; F41F 3/04

[52] U.S. Cl. ..... 89/1.805; 89/1.818; 89/8; 244/63

[58] Field of Search ..... 244/63, 114 R; 89/1.8, 89/1.801, 1.802, 1.803, 1.804, 1.805, 1.810, 1.815–1.819, 8; 102/283

[56] References Cited

U.S. PATENT DOCUMENTS

| | | | |
|---|---|---|---|
| 484,011 | 10/1892 | Haskell | 89/8 |
| 1,298,447 | 3/1919 | Bradford | 89/8 |
| 2,478,774 | 8/1949 | Meinel | 89/1.819 |
| 3,072,020 | 1/1963 | Barnes et al. | 244/63 |
| 3,132,562 | 5/1964 | Frevel | 244/63 |
| 3,363,508 | 1/1968 | Stahmer | 244/63 |
| 3,807,274 | 4/1974 | Cohen | 89/8 |
| 3,857,321 | 12/1974 | Cohen | 89/1.816 |

FOREIGN PATENT DOCUMENTS

| | | | |
|---|---|---|---|
| 1336054 | 7/1963 | France | 89/1.818 |
| 1431272 | 1/1966 | France | 89/1.818 |
| 2335817 | 7/1975 | France | 102/283 |

OTHER PUBLICATIONS

Vanden Kerskhove, "Recent Advances in Solid Propellant Grain Design", American Rocket Soc. Journal, pp. 483–490.

*Primary Examiner*—Galen L. Barefoot

[57] ABSTRACT

A system for launching heavy rockets from the shaft of a launching tower where a cluster of liquid-propellant motors is mounted to its base and a series of clusters of solid-propellant motors are mounted in the tower's columns, the latter motors being consecutively upwardly fired. The rocket is supported by a piston impinged by the jet of gases ejected by the tower's motors. The impinging jet of gases spreads out of the shaft through open windows which are provided in the tower's walls and the rising movement of the rocket inside the shaft is controlled along a given path of movement in a manner that the firing of motors and closing of windows ensure controlled pressures below the piston and as a result, controlled accelerations. The rocket leaving the tower disconnects the impinging piston and then fires its own motors, having at that point a kinetic energy greater than usual. Heavy rockets using the launching tower can put in their orbits useful loads much greater than usual due to the load of propellants and their tanks saved in the first stage of thrust.

2 Claims, 23 Drawing Figures

LAUNCHING TOWER FOR HEAVY ROCKETS

BACKGROUND OF THE INVENTION

This application is a continuation-in-part application of my application Ser. No. 850,227, filed Nov. 10, 1977, now abandoned.

The present invention relates to a method and apparatus for launching heavy rockets from a launching tower with stable motors, thus the first stage's motors of the rocket start when the rocket leaves the tower.

It is known that rocket's launching is accomplished by the first stage's motors of the rocket. These motors use liquid-propellants for heavy rockets. The requirements imposed by a maximum weight of useful load (payload) lead to a very high mass ratio of propellants from 10 to 20, and as a result it is necessary to have a maximum mass of propellants in the rocket's tanks, propellants which become the main elements of the rocket. The rocket was divided in stages, this being the only solution to reach the orbital speed and to be free from the Earth's gravitational field. Two or three stages are now utilized in the heavy launchers. The main problems difficult to be solved when augmenting the number of stages are: the growth in the take-off weight, the separation of a stage, and the firing of the ensuing one. The separation of stages one by one diminishes the mass of the rocket and increases the speed to the required limits. The first stage's motors of heavy rockets using liquid-propellants provides low take-off accelerations, and as a result the kinetic energy transfered to the rocket in launching is small. At take-off, the low speeds induce to high consumption of propellants, and the first stage's motors spend a lot of propellants to move the rocket and to impart it the initial speed. There are important power reserves to be found and utilized as long as a rocket will be let to solve the take-off phase by its own means, because the "specific consumption per unit covered distance" is maximum at launching. The rocket must solve the mission by its own means only after its exit from the radius of action of the Earth's equipments. Thus, the invention herein relates to an Earth launching utilizing stable equipments to accomplish the take-off, and to transfer to rocket maximum accelerations whose rates have to be controlled only to enable them to be withstood by the instruments and for the reason of safeguarding the occupants.

SUMMARY OF THE INVENTION

The launching tower of a steel structure is formed by a series of columns disposed in a regular polygonal shape circumscribed about a circle of an area cca. 2.5 greater than the area of the biggest cross-section of the heaviest rocket to be launched. A framed cylinder called "piston" is supported at an appointed distance from the ground inside the shaft of the tower. The rocket is placed on this piston. A cluster of liquid-propellant motors are set up in the tower's basement, their nozzles passing through the reinforced concrete slab covering the basement and being aimed upwards inside the tower. The tower's columns are braced by the frames of continuous windows provided with shutters closing at command. The tower has horizontal wings of steel plates placed on equidistant intervals less than the height of piston, to protect the rocket against the jet of flames and to brace the entire structure. Clusters of solid-propellant motors are placed inside the tower's columns being aimed upwards and providing cones of ejecting gases at their level behind the piston. The take-off is accomplished by the motors placed inside the tower in its basement and columns. The jets of gas impinge the couple piston-rocket and spread laterally through the open windows. The clusters of solid-propellant motors are fired just as each cluster is left behind by the bottom of the rising piston. When the rocket leaves the tower its own motors are fired and the impinging piston is disconnected.

The principal object of my invention is to provide the saving of take-off propellants which are now about 5% of the total propellant of a rocket to reach its height.

A further object of my invention is to provide greater accelerations at take-off and consequently a greater speed for the point representing the height of the tower. For a high tower it is possible to provide a take-off acceleration of 3 g and perhaps greater, performance which is impossible to be provided by the first stage of a heavy interplanetary rocket. In that case the saved propellant becomes about 15% of the total propellant.

A further object of my invention is to provide at take-off, when the rocket leaves the tower, a kinetic energy 30 times greater than usual.

A further object of my invention is to increase the useful load redistributing the saved load of propellants and their tanks. The total saving of about 15% is able to increase the orbital weight about 30% of its own weight. Due to these facts, the greater the rocket, the more efficient the new proposed launching system will be.

A further object of my invention is to provide rather big spacecrafts to be placed on Earth's orbit either to assure the returning of the crew to Earth from heavy interplanetary rockets or to place bigger masses on steady heavy Earth's satellites.

A further object of my invention is to use take-off motors which are free of hard conditions imposed in the building of rocket motors, their mass not affecting the results.

A further object of my invention is to provide more economical launchings reusing the tower with all its equipments including the piston which can be parachuted.

A further object of my invention is to provide launching of heavy rockets resisting to the action of the weather, because the component factors of the weather are insignificant in rapport with the kinetic energy of a rocket leaving the tower.

A further object of my invention is to provide "clean launchings" as a result of using a piston interposed between rocket and all torque of flames and great clouds of steam which now can easily damage part of a rocket.

These objects and advantageous features are apparent from the description and claims, but I think that it is more accurate to point out them distinctly as in the paragraph above.

Other objects and advantageous features of the invention will be apparent from the description and claims.

DESCRIPTION OF INVENTION

Before turning to a specific description of the present invention it will be advantageous to consider some theoretical considerations of the new proposed system and some general aspects concerning the launching of heavy rockets.

Figure 1:
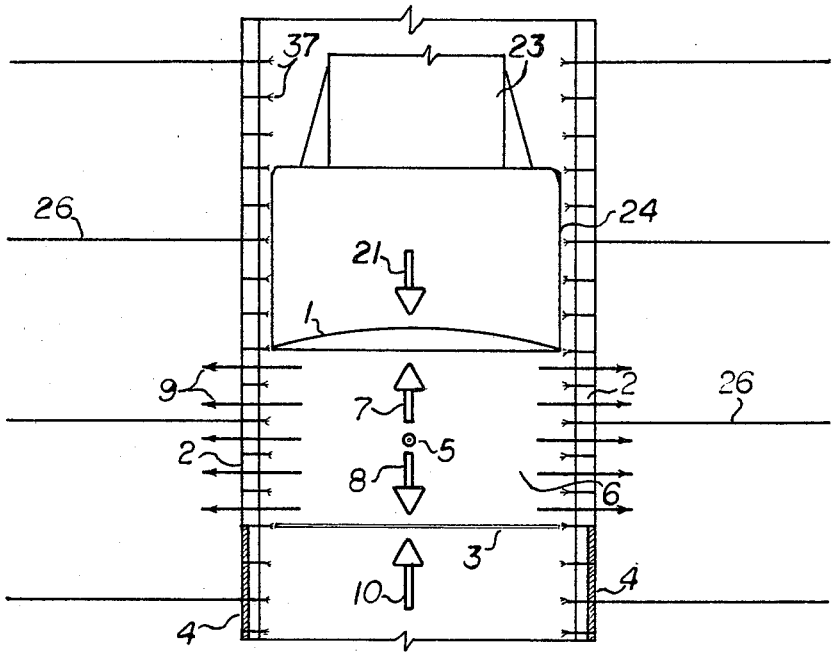
FIG. 1 is a sectional view through the working-chamber representing its working way.

FIG. 1 represents a sectional view through the working-chamber anywhere along the tower when the jet of gases impinges the couple piston-rocket. As a principle the rising piston is permanently followed by a "working-chamber" which is limited upward by the bottom of the piston 1, downward by the horizontal plane 3 which severs the open windows 2 from the shut windows 4, and laterally by the tower's walls which consists of columns and open windows. Imagine the center of gravity 5 of working-chamber being a spring and the plane 3 being a thin plate. Assume that the spring ejects the same mass of gas per second and at the same velocity as the tower's motors eject. Assume that the thrust 10 is a static force applied on the plate 3. The working-chamber is always in equilibrium. The pressure impinges the bottom of the piston 1 upward as thrust 7, the pressure acts downward as thrust 8 equal to thrust 7, while the pressure acts laterally as thrust 9 radially disposed on the open windows 2 being in reciprocal equilibrium. If the gas velocity through the open windows 2 equals the velocity of the springed gas, thrust 8 equals static force 10. If the gas velocity through open windows 2 is less than the sprung gas velocity, the gas will relax, thrusts 7 and 8 will decrease, and to maintain the equilibrium static force 10 must decrease. If the gas velocity through open windows 2 is greater than the sprung gas velocity, the gas will be compressed, thrusts 7 and 8 will increase, and to maintain the equilibrium static force 10 must increase. Consider the effective area of open windows, their open area reduced by the shape coefficient. In fact the gas velocity through open windows 2 depends on the ratio of the inside area of the tower to the effective area of open windows 2, and the velocity of gas through open windows 2 is the velocity of sprung gas times that ratio. The thrust which acts the bottom of the piston depends on the ratio of these two areas. When the areas are equal the ratio is 1 and thrusts 7, 8 and 10 are equal. When thrust 7 is greater than weight 21 of the couple piston-rocket, the couple moves. To move the couple for a heavy rocket of about 3,000 tons, the pressure inside the tower must be about 2 atmospheres, and to impart an acceleration of 3 g the pressure should be about 6 atmospheres. The area of open windows is of the first importance because it is able to adjust the increasing of accelerations to safeguard the occupants. If the area of open windows is out of control and diminishes under its safe limits, the pressure inside the tower increases over the bearable pressure and it will explode. To explain the working-chamber the phenomenons were simplified, in fact the velocity of gases is altered slightly by the increasing distance between the nozzles and the piston and low supplimentary pressures occur inside the tower and on the other hand the open windows could be anywhere between ground and piston either clustered or scattered.

Figure 2:
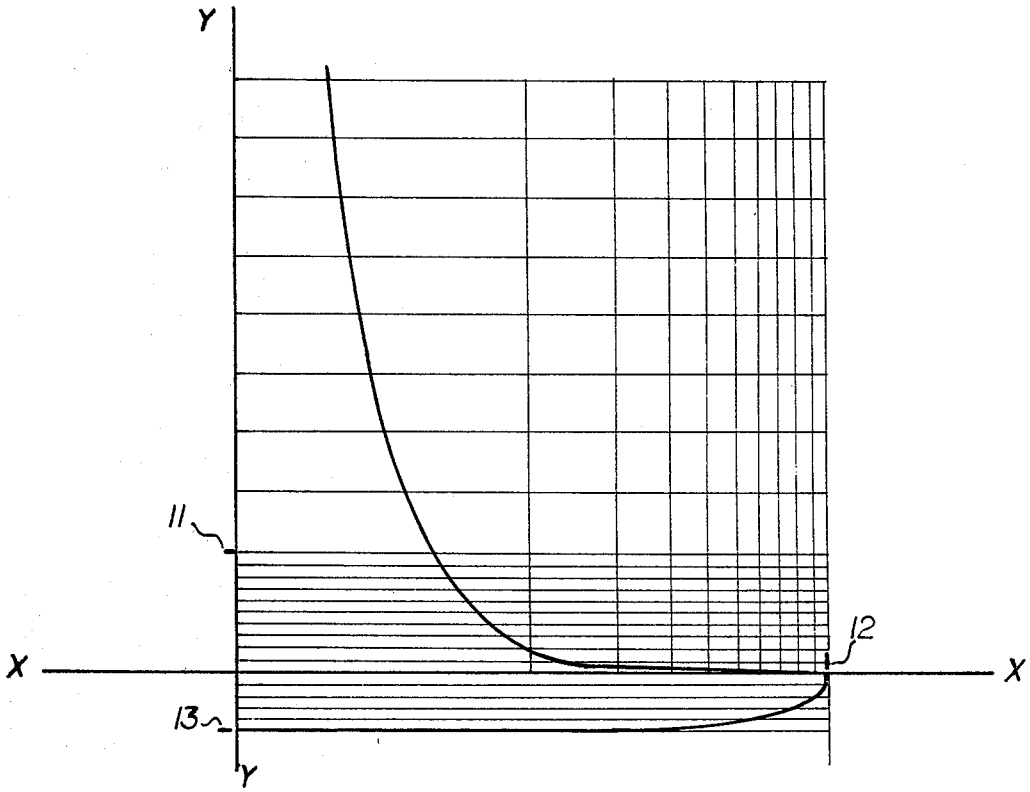
FIG. 2 is a graph of specific consumption per unit covered distance at take-off for the actual launchings.
Figure 3:
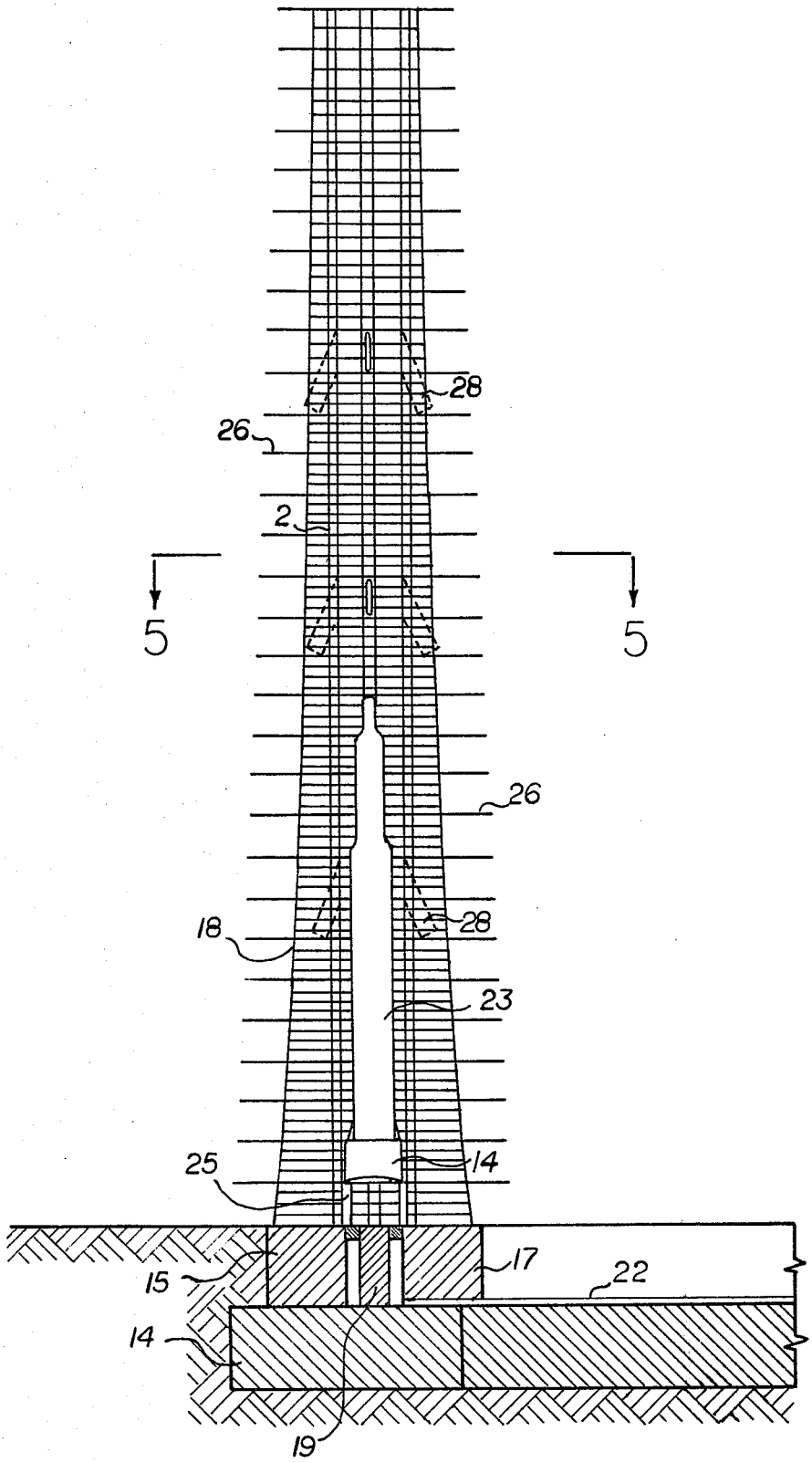
FIG. 3 is a sectional view of the launching tower.
Figure 6:
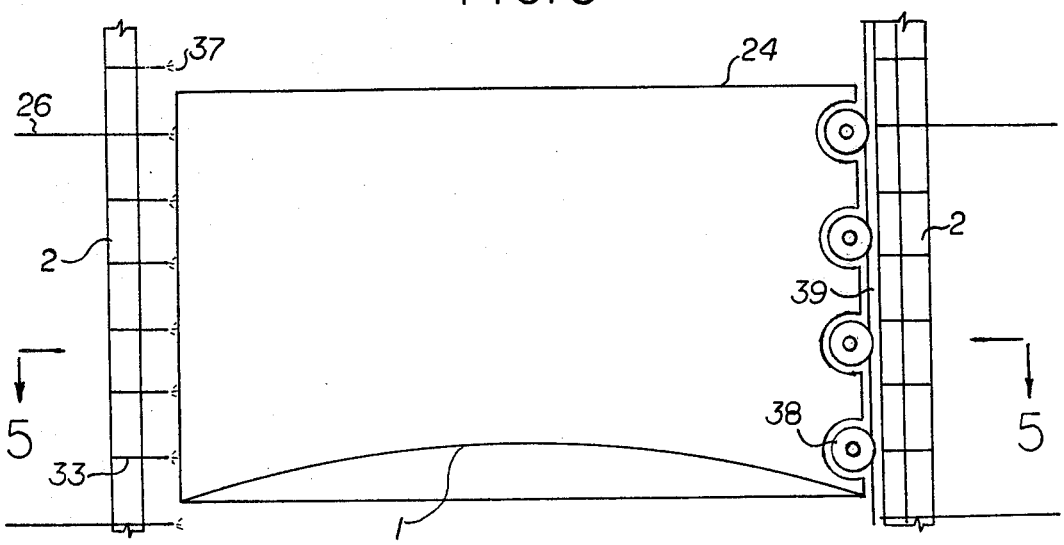
FIG. 6 is a sectional view along the line 6—6 of FIG. 5.
Figure 16:
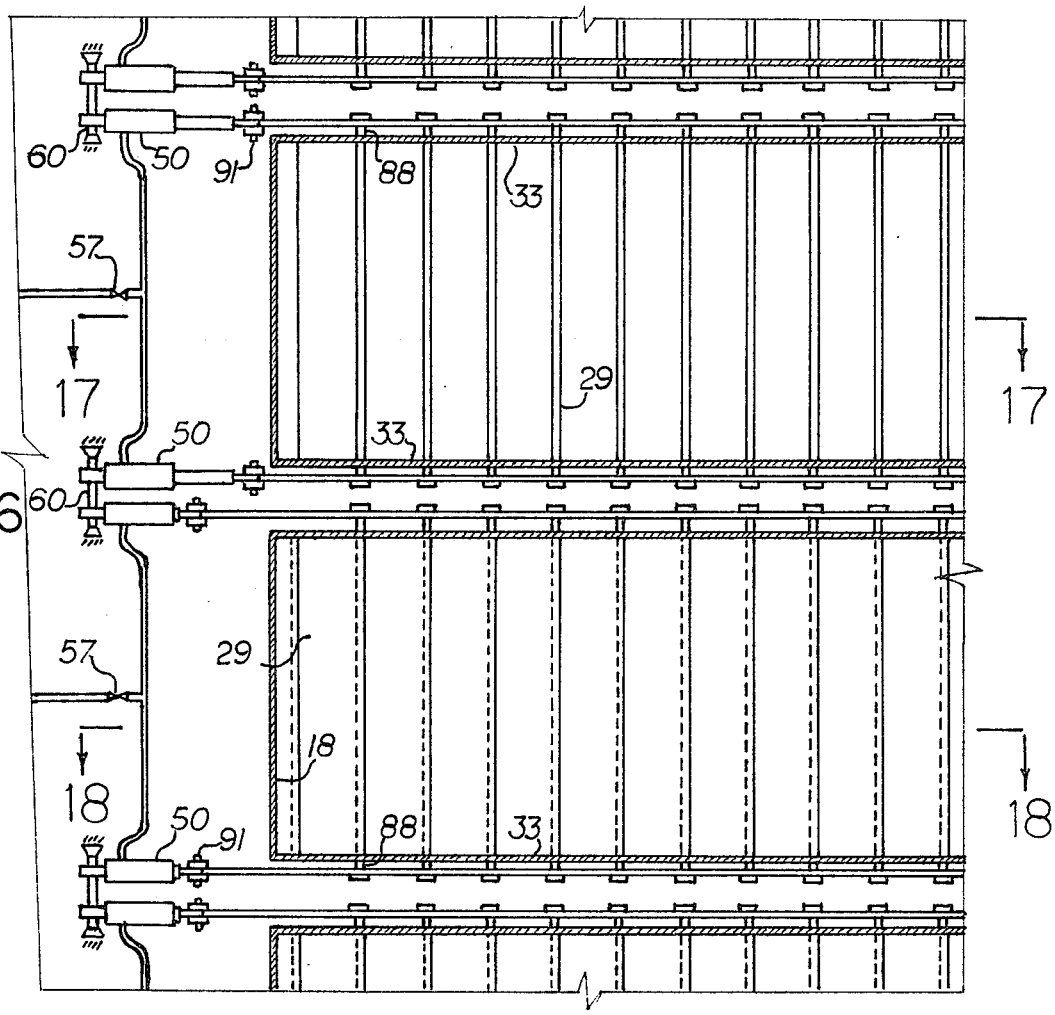
FIG. 16 is a sectional view through window frames and columns showing the shutters closed or open.
Figure 17:
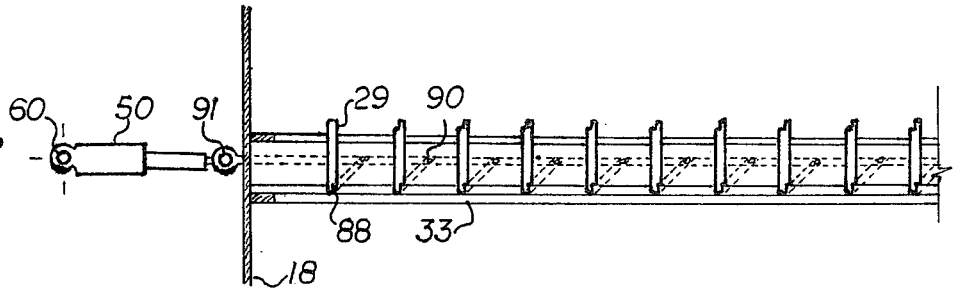
FIG. 17 is a sectional view along line 17—17 of FIG. 16.
Figure 18:
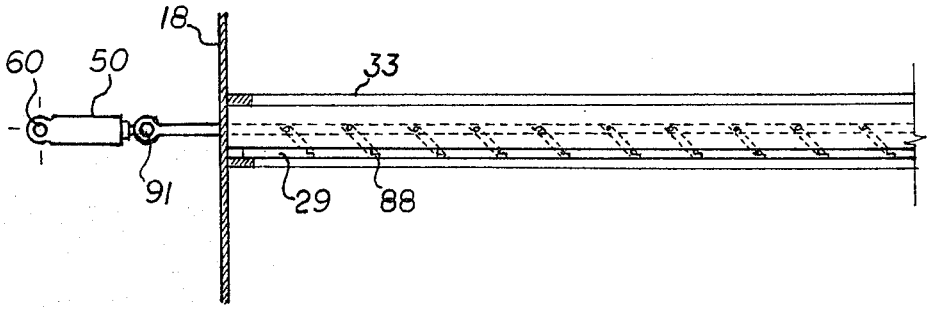
FIG. 18 is a sectional view along line 18—18 of FIG. 16.

The height of the tower depends on three main factors: the "specific consumption per unit covered distance", the speed to be obtained when the rocket leaves the tower, and the means of the building technology for the high steel structures. The "specific consumption per unit covered distance" is variable and in inverse ratio with the speed of the rocket. This fact is illustrated in the dual graph FIG. 2. Above the X axis the graph indicates the variation of the "specific consumption per unit covered distance" as a function of the distance covered by the rocket, and below the X axis the graph indicates the variation of the consumption per second before the movement of the rocket. To record the heights reached by the rocket above the ground, the vertical scale Y laid off above the X axis was graded in feet, and to record the seconds before the movement of the rocket, the vertical scale Y laid off below the X axis was graded in seconds. To make the graph more explicit, the X axis which represents the consumption of the rocket's motors in tons per second, was graded logarithmically. The point 11 represents the height of a heavy rocket, the point 12 represents the consumption per second of the rocket's motors when they develop their full thrust, and the point 13 represents the seconds from the starting of the rocket's motors to the movement of the rocket. It is evident that further away from the ground the rocket, the consumption per unit covered distance is less. The most important alteration of the specific consumption occurs up to the height of the rocket, then this one diminishes little by little. The area between the Y axis and the curve represents the consumption of propellants at take-off. Taking into consideration this curve it is possible to choose a suitable height of the tower to obtain the more suitable take-off saving of propellants. According to the take-off accelerations and to the maximum velocity to be provided when the rocket leaves the tower results in the power of the tower's motors, their number, and their positions, and consequently a new height for the tower. Comparing these heights with the limits of actual technological possibilities for the high steel structures, will result in the very height of the tower. It seems, that the height is around 1,000 feet. Turning to FIG. 3, the present invention will be seen embodied within a reinforced concrete foundation 14, including a series of basements 15, 16, 17 and the steel columns 18. In basement 16 are installed the liquid-propellant motors 19 with their nozzles 32 (FIG. 4) passing through the reinforced concrete slab 20 and being aimed upward towards the initial position of working-chamber 6. In basements 15 are fixed the tanks for liquid-propellants and the control equipments of liquid-propellant motors. Basement 17 bears the mobile side of the tower called "the tower gate", and inside this basement are set up the engines, not shown, to move the tower gate over rail-ways 22 when the tower opens to allow the setting of rocket on its take-off position. Rocket 23 is set on piston 24 which is supported by bearings 25. Bottom 1 of piston 24 is concave to group better the jet of gases aimed upward. Piston 24 is braced inside by radial diaphragms to ensure its undeformability. Columns 18 are set in a polygonal shape of minimum six sides (FIG. 4), and their cross section is inscribed in a trapezoid, its shortest side being curved and placed inside the tower. For a smooth running of gases through open windows, the inside elements of the structure have aerodynamic shapes. The walls of the tower must be protected to prevent them from melting. Can be used known methods like the encasing in materials which dissipate the heat by progressive ablation or wall-cooling effected by circulating liquids. Mobile columns 30 make up the tower gate, its height being a few greater than the sum of heights of: working-chamber 6, piston 24 and rocket 23. Fix parts of columns 31 placed above mobile columns 30 are supported by bracings to adjacent columns 18 to maintain their position when the tower gate moves. Mobile columns 30 are connected to fix columns 31 and adjacent columns 18 by splices, not shown, when the tower shuts its gate. The tower's columns 18, 30 and 31 are braced by horizontal frames 33 of windows and by wings 26. The windows are placed between wings 26 as shown in FIG. 1, FIG. 3 and FIG. 6, and the mark of windows is 2 when they are open and 4 when they are shut. Wings 26, made of steel plates, are disposed on horizontal planes spaced not more than the height of piston 24. They brace the structure and protect the rocket against the jet of flames. Before take-off all the tower's windows are open. Open windows 2 placed below piston 24 give dimension to working-chamber's height. Gradually, as piston 24 rises and moves past a series of open windows 2, its magnet 36 excites a pick-up coil 40 installed inside a column, one for each series of windows. The signal of coil 40 is passed to amplifier 56 (FIG. 19*a*) from which it activates a relay 61 associated with six pairs of servo-valves 57 for rams 50 which shut shutters 29 (FIG. 16) of the lowest series of open windows 2 of working-chamber 6. Shutter 29 of a window is closed by two pairs of rams 50 installed symmetrically in the adjacent columns, and these four rams 50 of a shutter are activated in pairs by two servo-valves 57 (FIG. 16). The mechanism rams-shutters works using fix axles 60 and 88, mobile axles 91 and 90, and levers 82 and 87 (FIG. 16, FIG. 17 and FIG. 18). Determination of where the pick-up coil 40 has to be fixed depends on the distance between the magnet 36 and the bottom of the working-chamber, and on the delay between the time the magnet 36 excites the pick-up coil 40 and the time the rams 50 shut the shutters 29 of the lowest windows of working-chamber so that the height of working-chamber 6 to be invariable. As will be further disclosed, the working-chamber is divided in two divisions and the control of windows already disclosed refers to the upper division of the working-chamber.

Figure 5:
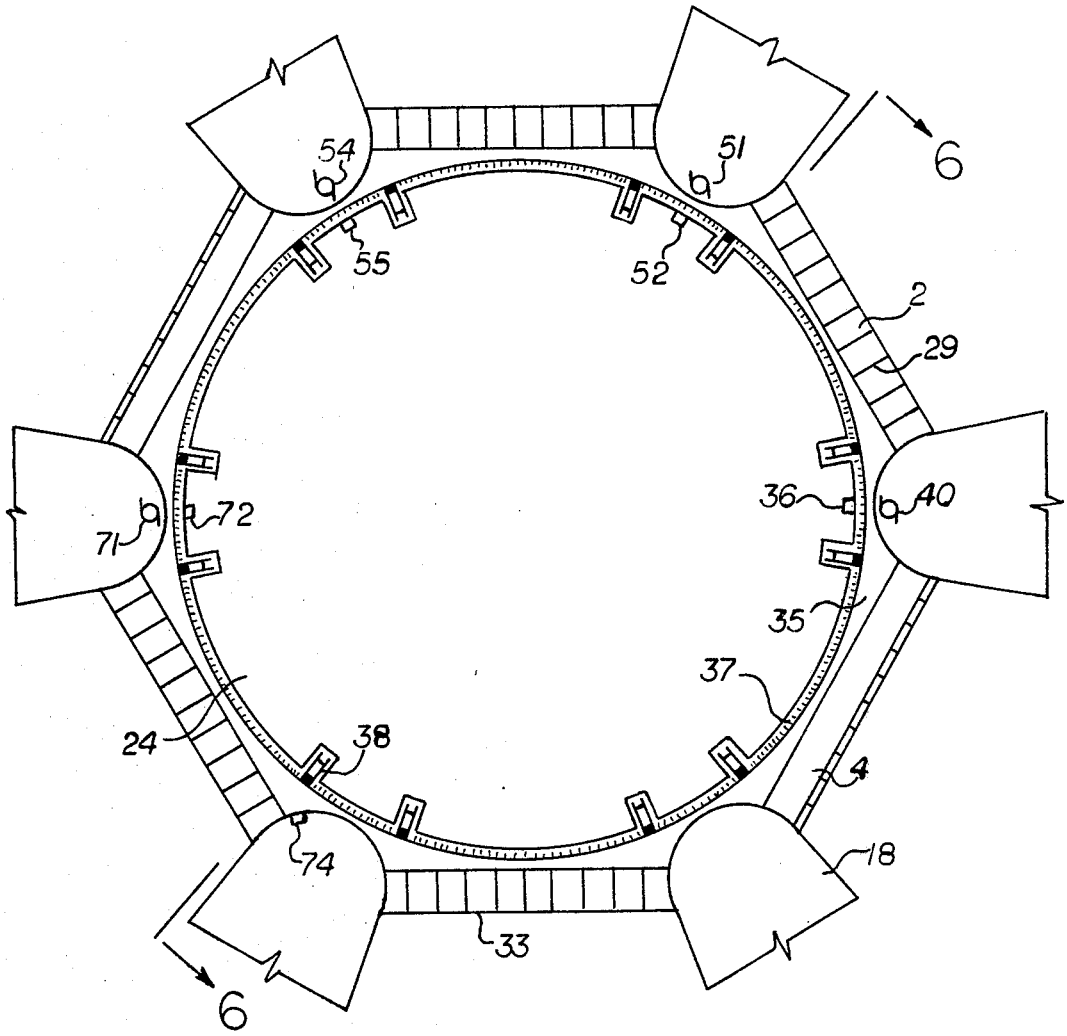
FIG. 5 is a horizontal sectional view along the line 5—5 of FIG. 3 when the piston is at that level, or a horizontal sectional view along the line 5—5 of FIG. 6.
Figure 7:
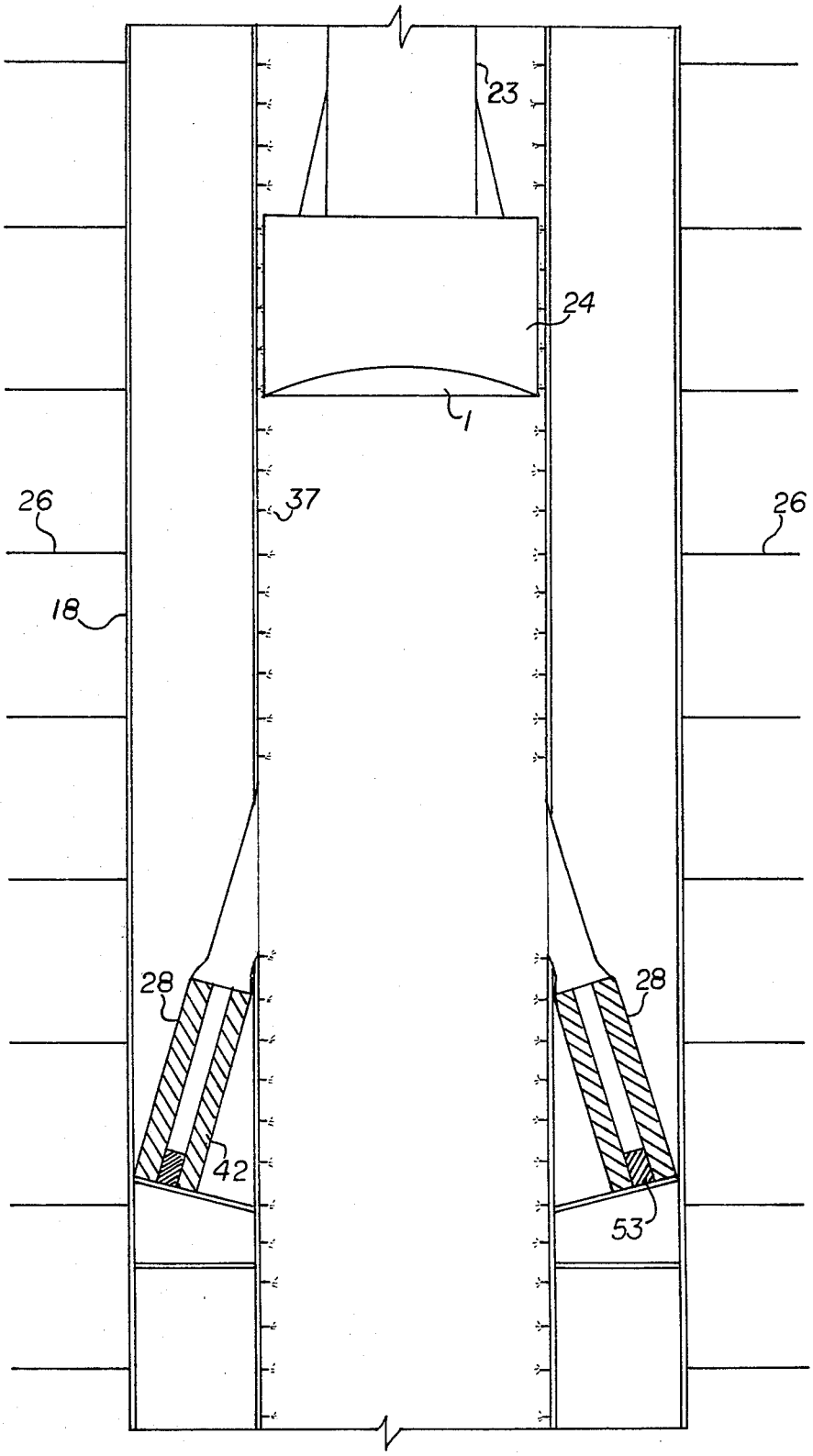
FIG. 7 is a sectional view of a fragment of the launching tower at a level with solid-propellant motors.
Figure 8:
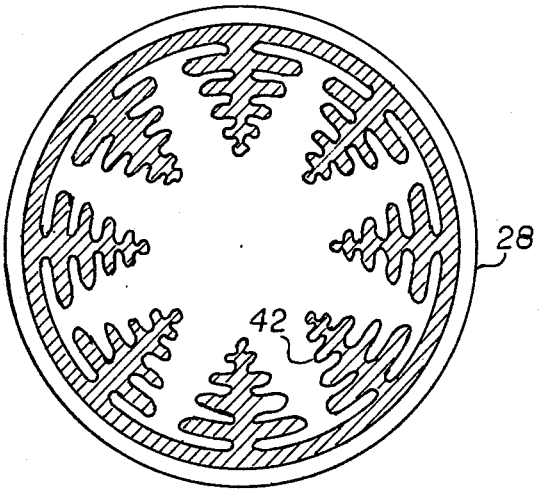
FIG. 8 is a sectional view through a solid-propellant motor.
Figure 9:
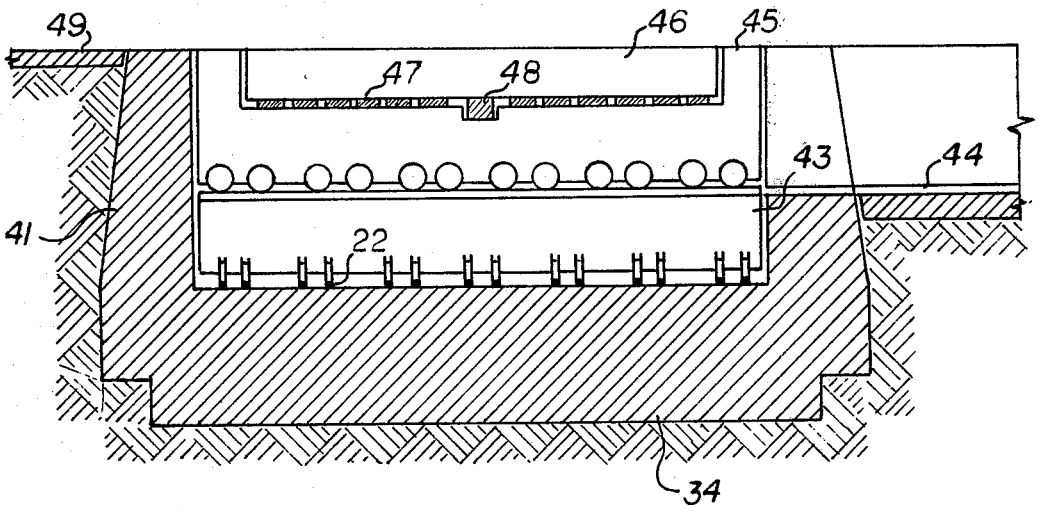
FIG. 9 is a sectional view along the line 9—9 of FIG. 10.

Inside the tower each frame 33 of windows and each wing 26 has a circular plate 35 which shapes a concentric outside circle to piston 24. The inside edges of these circular plates 35 are provided with wire brushes 37 wiping the vertical wall of piston 24 in its rising movement to tighten the space between piston 24 and plates 35 against the rising jet of flames. Piston 24 rises being guided by wheels 38 which roll over rail-ways 39 mounted on the tower's columns. Columns 18, 30 and 31 are enclosed and have inside them the solid-propellant motors 28 and all equipments to control: the shutting of windows, the firing of solid-propellant motors, the launching system and the safe devices. As seen in FIG. 7 the solid-propellant motors 28 are installed inside columns 18. The acute angle of motors with the vertical allows them to provide a cone of jets which impinges piston 24 similarly with the basement's motors, but more powerfully providing high accelerations. Motors 28 are mounted at different levels forming stages of thrust as will be shown furthermore. A solid-propellant motor 28 has inside a solid-propellant 42 in a star-shape with its central hole surrounded by compact corners, each one notched as a pine needle to obtain a maximum thrust for a short time. Inside the columns is fixed a second series of pick-up coils 51 one for each cluster of solid-propellant motors. Piston 24 has a second magnet 52 which excites in its rising movement the coils 51 (FIG. 5). The signal of coil 51 is passed to amplifier 58 (FIG. 19*c*) from which it activates relay 63 associated with all six igniters 53 of a cluster of solid-propellant motors 28. Pick-up coils 51 are fixed at appointed heights taking into account: the delay between the time magnet 52 excites pick-up coil 51 and the time igniter 53 fires solid-propellant 42; and the fact that the jet of gases of a cluster of solid-propellant motors must eject just as the nozzles of its motors are left behind by the bottom of piston 1 in its rising movement, this means the distance between the magnet 52 and the bottom of piston 1.

Figure 4:
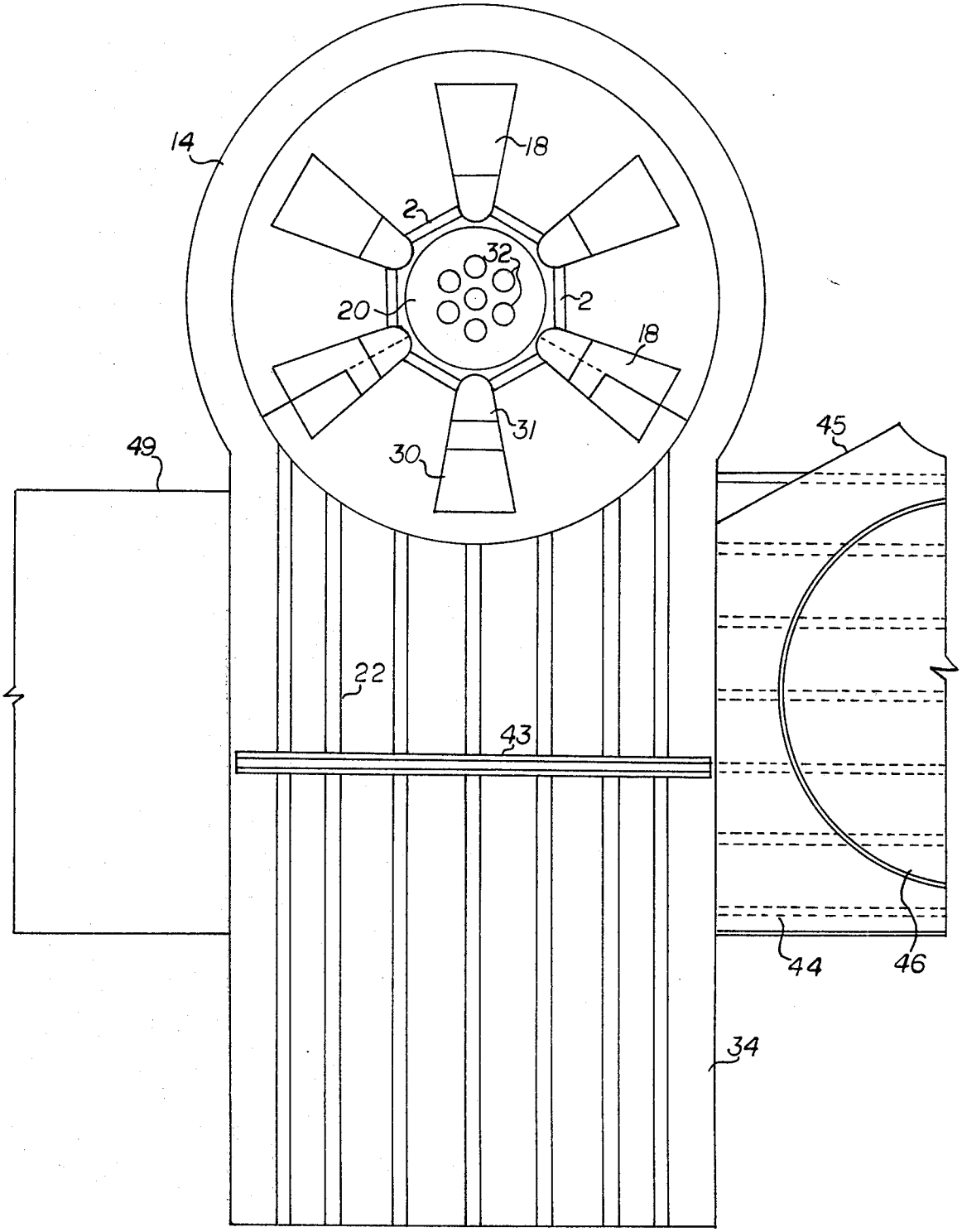
FIG. 4 is a top plan view of the launching tower and its adjoining platforms, without wings and rocket.
Figure 10:
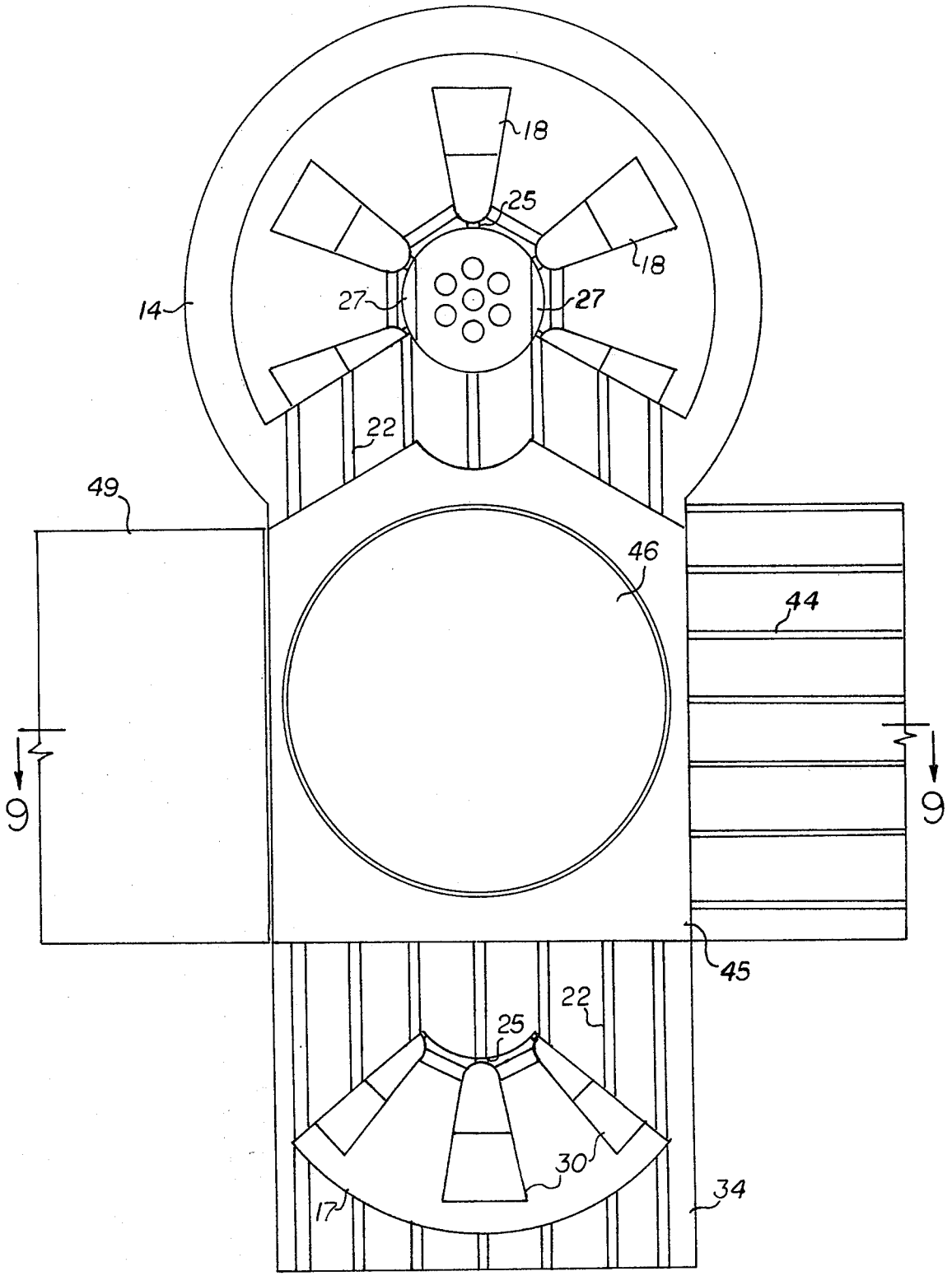
FIG. 10 is a top plan view of the launching tower when it is open, its displaced tower-gate and its rolling bridge in the receiving position of the rocket.

In FIG. 10 the tower is open its gate being moved on rail-ways 22 at the very end of platform 34. In FIG. 4 a rolling girder 43 is set on rail-ways 22 as an example. When the tower gate is moved at the end of platform 34 a plurality of rolling girders 43 are set on rail-ways 22 and are braced all together. Rolling-bridge 45 moves on rail-ways 44 stopping between the tower and its gate. The rolling bridge is equipped with a turn-table 46 turning around axle 48 on rolls 47. The access of vehicle carrying the couple piston-rocket towards the tower occurs on road 49. The platform 34 is provided with retaining wall 41 which allows the passing of vehicle from road 42 to turn-table 46 which turns around 90 degrees allowing the couple to get inside the tower. Piston 24 is divided in three parts by two symmetrical vertical planes separated by a distance approximately equal to the biggest diameter of heavy rocket 23. The central part of piston 24 comes on the vehicle supporting heavy rocket 23 and the lateral parts 27 are waiting inside the tower on bearings 25. Inside the tower these three parts of piston 24 are solid jointed between them shaping one unit which is clamped by steel jaws of the structure not shown. The vehicle withdraws and returns the same way. Rolling bridge 45 moves outside on its rail-ways 44 and rolling girders 43 are taken off. The tower gate slides towards the tower on its rail-ways 22 and shuts the tower. The rocket is prepared for launching. At take-off the vernier motors of the rocket start first to ensure the stability of the rocket. The jet of gases of vernier motors leaves the tower through open windows 2 above piston 24. Liquid-propellant motors 19 from the basement start and when they develop their full thrust the jaws open and the jet of gases impinges the couple piston-rocket and spreads laterally through open windows 2 leaving the tower. The thrust of motors 19 being bigger than the weight of couple 21 and the effective area of open windows below piston 24 being equal to inside area of the tower, the couple piston-rocket moves starting its rising movement. Piston 24 rises being guided by wheels 38 which roll on their rail-ways 39 mounted on the tower's columns.

Figure 11:
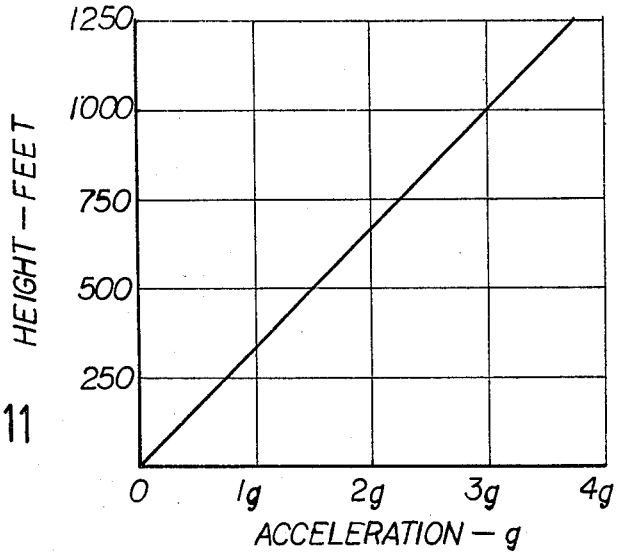
FIG. 11 is a graph of accelerations inside the launching tower.

The entire launching is programmed and controlled. The pressures which impinge the couple piston-rocket are low, of the order of 2 to 6 atmospheres achieving an acceleration of about 3 g when the rocket leaves the tower. The launching programme consists of the following graphs concerning the rising movement of heavy rocket inside the tower:

The desired accelerations FIG. 11 which is a scheduled line and which must respect a safe variation for crew and instruments.

Figure 12:
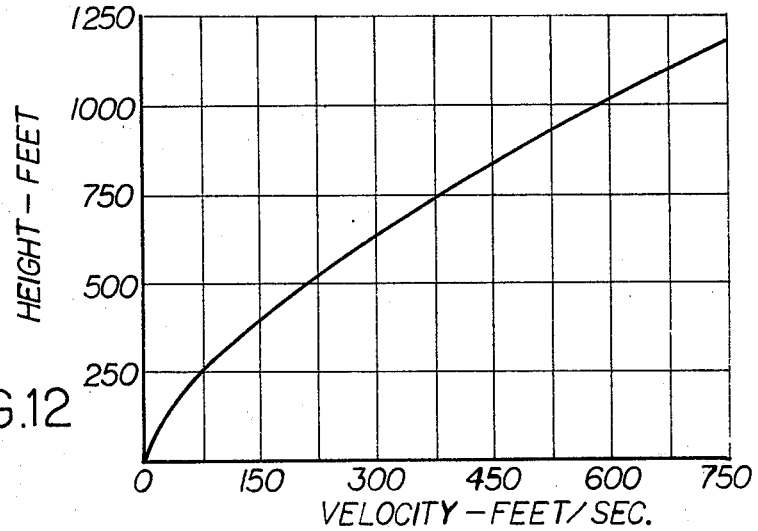
FIG. 12 is a graph of velocities inside the launching tower.

The graph of velocities FIG. 12 as a result of desired accelerations.

Figure 13:
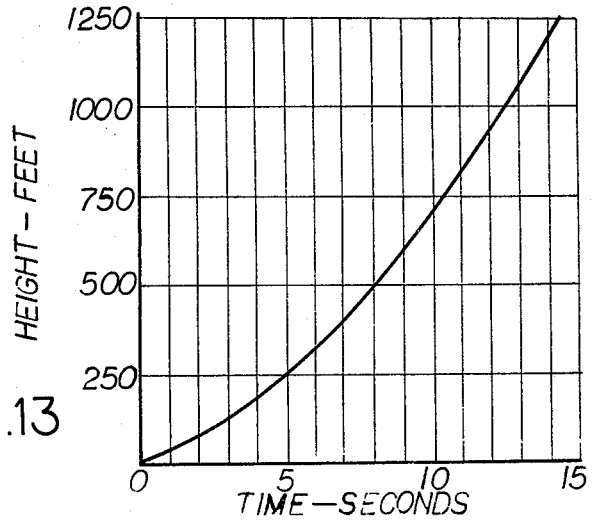
FIG. 13 is a graph of the relationship between the heights of the launching tower and the necessary time for couple piston-rocket to reach the different heights.

The graph of times FIG. 13 as a result of velocity's graph.

Figure 14:
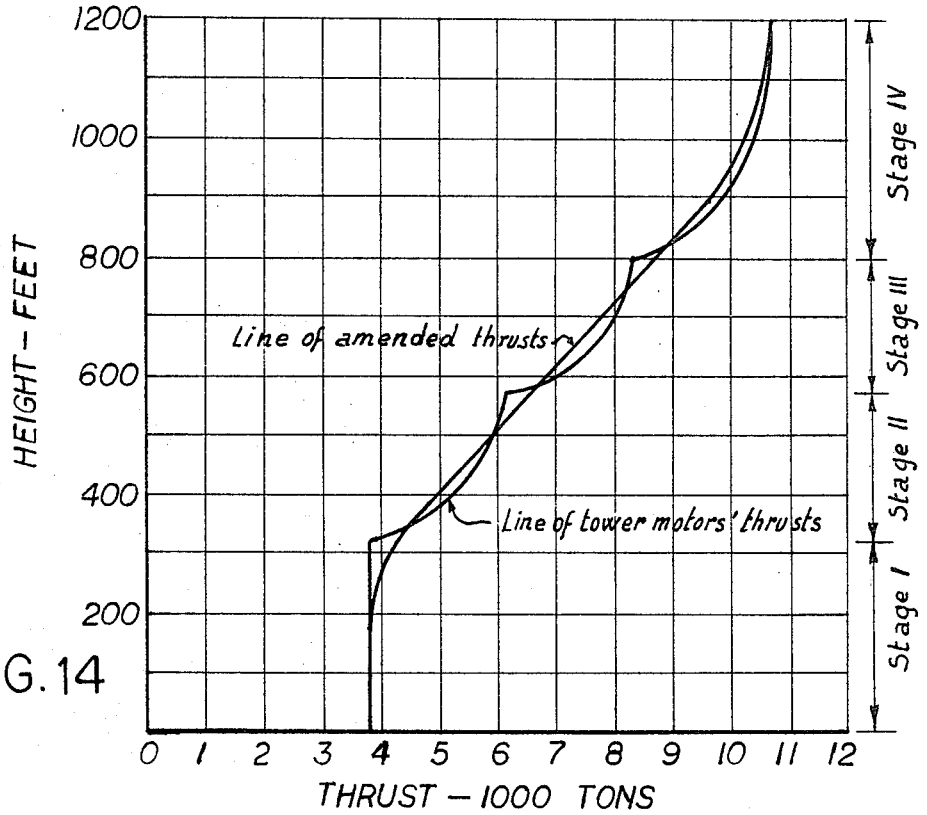
FIG. 14 represents the stages of thrusts inside the tower, the graph of the tower motor's thrusts and the graph of amended thrusts.

The graph of thrusts FIG. 14 which covers the graph of desired accelerations. This graph contains two liners. The first one is discontinuous representing the sum of thrusts of all motors as they run underneath the bottom of the piston in its rising movement. The second one is an amended line of thrusts removing the discontinuities of the first one and yielding a continuous increasing acceleration. This graph decides the number of stages of thrust and also the greatness and the location of each stage of thrust as a result of covering the desired accelerations of FIG. 11.

Figure 15:
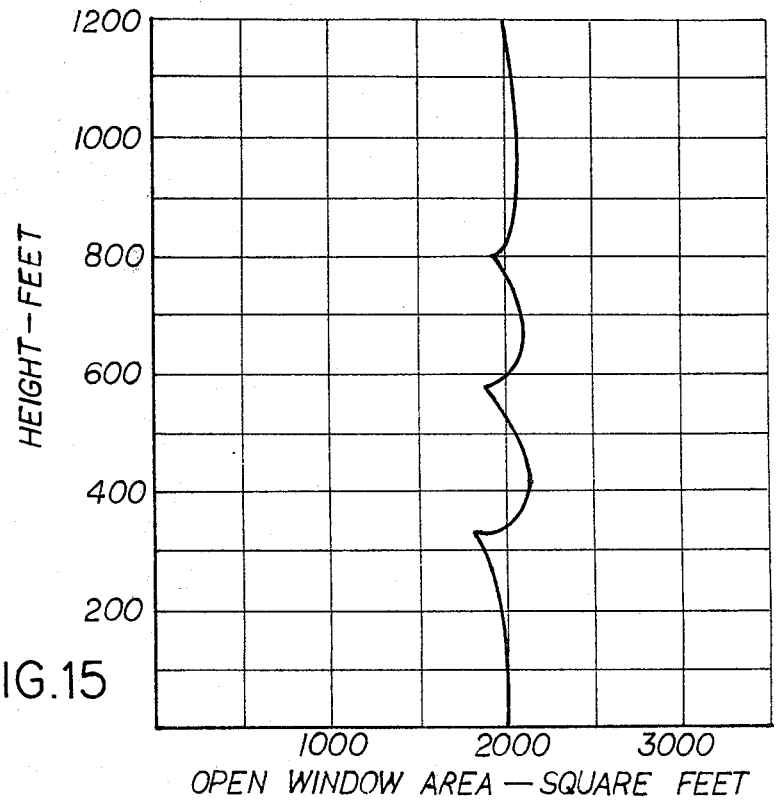
FIG. 15 is a graph of areas of open windows.

The graph of open window areas FIG. 15 which in combination with the first line of thrusts FIG. 14, allows the amended line of thrusts.

The accelerations inside the tower are in function of pressures applied towards the bottom of piston 1. The variation of pressure can be achieved by three means: varying the thrust in steps, varying the area of open windows or combinations between the first two in other words varying the thrust at the same time with the area of open windows. The third means is necessary because it allows a smooth increasing of acceleration avoiding shocks as a result of firing the clusters of solid-propellant motors in steps. It will be disclosed for one discontinued point of first line how the operation of shutters 29 can change the first line into an amended one which is the second line FIG. 14. Before reaching height h, the pressure below the bottom of piston 1 can be increased by diminishing the standard area of open windows considering the differences between the abscisas of both lines for the same heights. D1 is a negative difference and decides the area of windows to be closed for that height. D2 is a positive difference and decides the area of windows to be supplimentary open. For an assigned height of the tower, the difference between the abscisas of those two lines of thrust with its sign divided by the sum of the effective thrust at that point establishes the percentage of standard opened window area to be closed or open as the sign is negative or positive; the standard open window area being the inside area of the tower increased by the shape coefficient of open windows. For the reason to facilitate the maneuver of shutters 29 concerning these corrections, the standard area of open windows is divided in two. A big percentage of standard area e.g. 80% follows the bottom of piston 1 and the rest of 20% of standard area remains permanently close to the ground. These percentages are merely illustrative. The area following the piston is constant and the area close to the ground is variable as the amended line of thrusts requires. On one column 18 is fixed a third series of pick-up coils 54 as the amended line of thrusts requires. As an example, according to the graph of FIG. 15, for each height being a corresponding positive or negative corrective area of windows, may be chosen those heights corresponding to pairs of window, and for each one to be installed a pick-up coil 54 at the respective height, the coil being destined to ensure the maneuver of windows required by its height. Piston 24 has a third magnet 55 which excites in its rising movement coils 54. The signal of coils 54 is passed to amplifier 59 (FIG. 19*b*) from which it activates relay 62 associated with pairs of servo-valves 57 for rams 50 which shut or open a number of shutters 29 close to the ground as the respective correction requires. These coils 54 are placed at known heights where there are known corrections and each circuit activates rams 50 of shutters 29 as its height requires, including the shutters operated by previous coil 54. That means if a coil 54 has operated the shutters opening 4 windows and the next coil 54 has to operate the shutters to open 6 windows according to the amended line of thrusts, it is programmed to open only the difference, in fact two windows, and so on. The position of coils 54 depends also on the delay between the time the magnet 55 excites pick-up coil 54 and the time rams 50 shut shutters 29 effectively. When it is necessary to activate the shutters for less than six windows, pairs of windows will be activated disposed symmetrically to avoid the horizontal unbalanced loadings. This fact occuring close to the ground, the supplementary tensions in the cross section of the tower will be equilibrated by buttresses supporting the base of the columns.

Figure 19A:
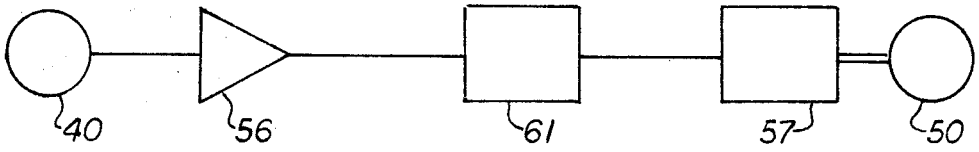
FIG. 19*a* is a circuit diagram of the sensing and monitoring system employed for the upper part of the working-chamber.
Figure 19B:
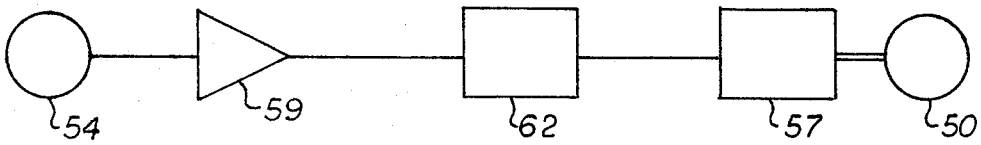
FIG. 19*b* is a circuit diagram of the sensing and monitoring system employed for the lower part of the working-chamber.
Figure 19C:
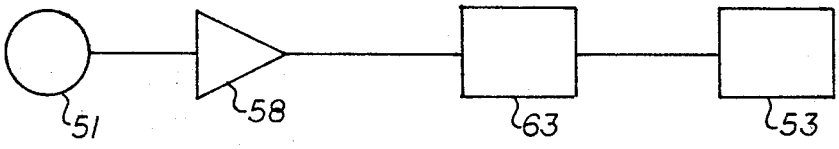
FIG. 19*c* is a circuit diagram of the sensing and monitoring system employed for firing the solid-propellant motors.

In conclusion the rising movement of the couple piston-rocket inside the tower is programmed by graphs of thrusts and open window areas (FIG. 14 and FIG. 15) and controlled by magnets 36, 52 and 55 which are mounted inside piston 24. They control according to the pre-established programme the closing of windows and the firing of solid-propellant motors. It is evident that any other mechanical means may be used to accomplish the same programme. FIG. 19*a*, FIG. 19*b* and FIG. 19*c* are diagrams of the sensing and monitoring system employed in the present invention. The first controlls the windows of the upper division of the working-chamber, the second controlls the windows of the lower division of the working-chamber, and the third controlls the firing of solid-propellant motors. Each pick-up coil 40, 54 or 51 is a part of a control circuit comprising an amplifier 56, 59 or 58 which receives a signal from its respective sensor. The amplifier is connected in line with relay 61, 62 or 63 to operate servo-valves 57 or igniters 53. A servo-valve 57 operates its corresponding rams 50 of shutters 29.

Figure 20:
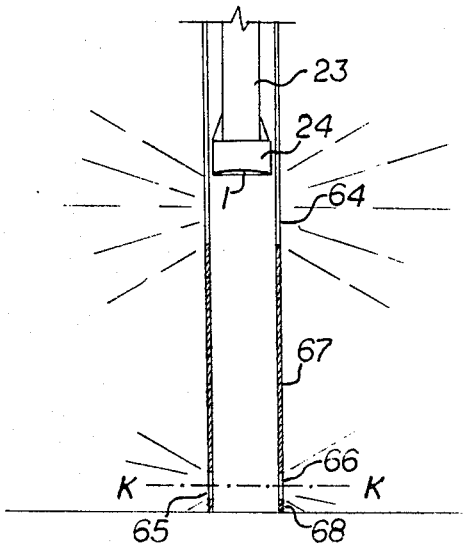
FIG. 20 is a schematic view showing the different divisions of the working-chamber.
Figure 21:
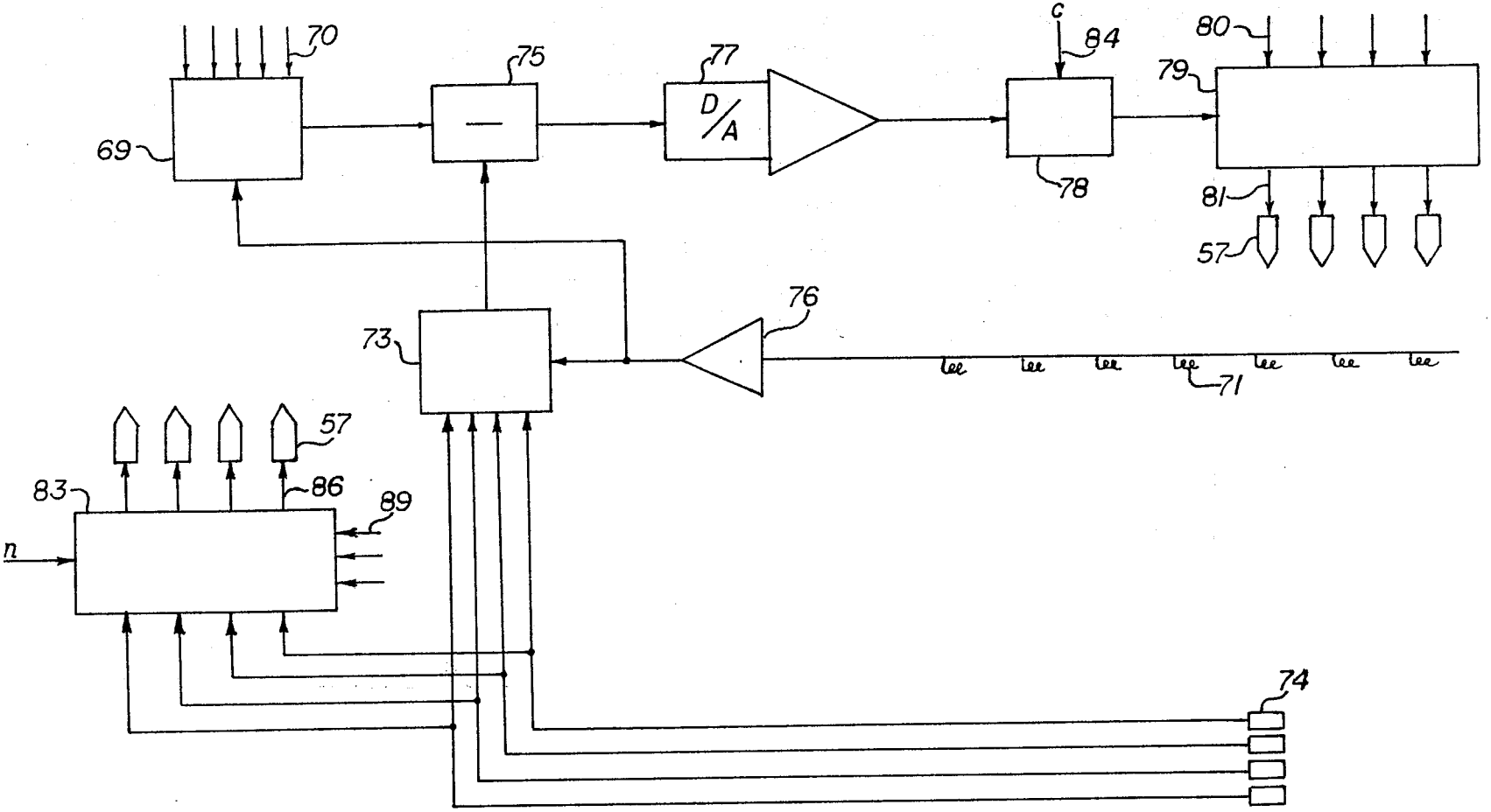
FIG. 21 is a schematic view showing the safe control launching means.

Safe devices are necessary to ensure the correct development of thrusts beneath the bottom of piston 1 in order to achieve the amanded line of thrust (FIG. 14) and consequently a smooth increasing of accelerations in spite of any deficiency which could occur to the previously described devices which are programmed and prepared for take-off. Also, safe devices are necessary to ensure the security of the launching tower against any kind of events. In FIG. 20 the working-chamber is divided in two divisions: the upper division 64 having 80% of its standard area and the lower division having 20% of that area. For an easier control of the tower's devices, the lower division is divided by plane k—k in two equal subdivisions. Lower subdivision 65 was selected to be operated by pick-up coils 54 for known corrections of the amended line of thrusts. Subdivision 65 has below it an equal area of closed windows 68 necessary for positive corrections. Subdivision 66 was selected for safe devices to ensure the correct development of thrust having above it closed windows 67 whose lowest part is used for positive corrections of safe devices. The safe devices are computer controlled. In FIG. 21 the apparatus is schematically shown activating so many windows as to correct the launching devices in order to ensure the launching path. Selector computer 69 is provided with a plurality of inputs 70. The inputs are: the heights of each series of windows and the corresponding desired pressures according to the amended line of thrusts (FIG. 14) as the bottom of piston 1 passes this series. The pick-up coils 71, one for each series of windows, excited by the magnet 72 feed, after suitable amplification 76 and shaping, selector computers 73 and 69. Every series of windows is also provided with a pressure pick-up 74 which inform selector computer 73 how heavily the pressure inside the tower is pushing the walls beneath the working-chamber. Pressure sensors 74 may be of any desired and conventional construction such as are disclosed in, "Electrical Measurements and Their Applications" by Walter C. Michels, D. Van Nostrand Co. Inc. Such gauges are calibrated and to compensate the temperature they are used in pairs as adjacent arms of the bridge circuit, or used four gauges as the bridge. When they are used four, two in diagonally opposite arms are placed parallel to the strain and the other two at right angles to this direction giving double sensitivity. The inductive gauges are better in this case because they are not as sensitive to temperature as are resistive gauges. The pressure sensors may be placed onto the inner face of columns 18 and arranged to send signals to selector computer 73. The selector computer 73 selects for each height registered by coils 71 the corresponding pressure registered at that height by pressure pick-ups 74 and informs the counter comparator 75 the instant pressure below the working-chamber. Concimitantly selector computer 69 informs counter comparator 75 the corresponding desired pressure for the achieved height. The counter comparator 75 compares these two pressures and sends a signal, which represents the difference of pressures with its sign, to digital-to-analog converter 77. Analog divider 78 has an input 84 for a constant c which represents the corresponding increasing or decreasing of pressure for a pair of windows which are supplementary closed or open and is controlled from digital-to-analog convertor 77. Analog divider 78 computes the number of pairs of windows to be closed or open as the sign is and feeds computer 79. Computer 79 contains the state of the windows of subdivision 66 permanently and the lowest part of closed windows 67 (FIG. 20) which inform the computer 79 through its inputs 80. The information may be sent by the corresponding servo-valves or rams and their position or by any other means. The computer 79 controls through relays 81 corresponding servo-valves 57 which activate rams 50 of shutters 29 to be closed or open in subdivision 66 or in the lowest part of closed windows 67 as the sign is. Computer 83 is used to ensure the security of launching tower. This computer has an input for a constant n which represents the highest pressure for which the tower's structure was computed multiplied by a safety factor e.g. 1.15 and it is informed by pressure pick-ups 74 about the corresponding pressure for each series of windows already registered by inputs 89. Computer 83 compares the information of pick-ups with the constant n and when one or more pressure pick-ups rises above the limit n the computer controls through relays 86 servo-valves 57 of corresponding rams 50 of shutters 29.

Such a method and apparatus places the launching process under the control of computers which can quickly compute the pressure differences at any point and make the necessary corrections to keep the acceleration at the required levels. Such a method and apparatus is, of course, merely illustrated and described to enable one to understand the complete operation of the present invention and may, as will be evident to those skilled in this art, be readily modified and equivalents used. Accordingly, the disclosure should not be taken as being a limitation on the invention. The elements of the tower's structure as: columns, window frames, shutters and wings, are loaded by forces as a result of achieved pressures below the working-chamber, and by the reactions of solid-propellant motors mounted inside columns. The stresses in the elements of the tower as a result of such loads are common and they allow the accomplishment of this launching tower with the present known technology. The principles of the working-chamber is possible to be investigated in the laboratory. So that the shapes of the elements, the dimensions and the efficiency may be established by exact data. The whole system is possible to be investigated on a reduced scale, and even a real scale test load may be launched to allow enough safe launchings. The tower's motors are built being free of hard conditions imposed in the building of the rocket's motors, their mass not affecting the results. Finally, the system affords the precious advantage of being reused for rockets of different dimensions.

What is claimed is:

1. A launching tower for heavy rockets, comprising in combination steel columns shaping a polygonal structure with a central shaft several times deeper than the height of a heavy rocket; a basement of reinforced concrete having a central chamber and a series of lateral chambers; a reinforced concrete slab over said basement; a plurality of holes in said reinforced concrete slab above said central chamber; a cluster of liquid-propellant motors mounted inside said central chamber, said liquid-propellant motors having their nozzles aimed upward though said holes of said reinforced concrete slab; said lateral chambers being for storage of liquid-propellants and for control equipments of said liquid-propellant motors; a plurality of series of windows disposed between said columns and all along said launching tower; frames of said windows bracing said columns; a shutter for each said window; rams for each said shutter mounted inside said columns and closing or opening said shutter at command; a piston bearing said heavy rocket inside said shaft of said launching tower; bearings supporting said piston in said shaft at an appointed height from said reinforced concrete slab; said piston having its bottom concave and being framed inside by dyaphragms; a plurality of wheels mounted in a vertical series outside said piston, one series of wheels for each said column; a central part and two equal side-parts of said piston being solidly jointed between them inside said shaft and forming together with a heavy rocket a first couple; said side-parts of said piston being separated by a distance approximately equal to the biggest diameter of a heavy rocket; said central part of said piston forming together with a heavy rocket a second couple; a plurality of wings made of steel plates bracing said columns; said wings being disposed on horizontal planes spaced not more than the height of said piston and extending outside of said launching tower; a plurality of circular plates being disposed horizontaly inside said shaft one for each said frame of said windows and one for each said wing; said circular plates shaping concentric circles inside said shaft close to the vertical series of wheels of said piston; brushes provided on all said circular plates wiping said piston in its rising movement; rail-ways mounted one on each said column and guiding said series of wheels of said piston; a plurality of clusters of solid-propellant motors mounted inside said columns; each of said cluster of solid-propellant motors having one motor in each said column at the same level and dividing said launching tower in stages of thrust: said solid-propellant motors of one said cluster being aimed upward and providing at their level when necessary a cone of ejecting gases; a tower gate, its height being as big as to receive inside said shaft said second couple at the level of said bearings; a mobile basement of said tower gate provided with wheels; a platform provided with a plurality of rail-ways for moving said mobile basement to cause the opening or closing of said tower gate; a plurality of rolling girders which are temporary setting on the rail-ways of said platform when said tower gate is open; a rolling bridge sliding on said rolling girders between said launching tower and said open tower gate; a turn-table mounted on said rolling bridge receiving said second couple; said turn-table turning around 90 degrees and allowing said second couple to get in said shaft where are awaiting said side-parts of said piston to be solid jointed to said central part of said piston to form said first couple.

2. A launching tower for heavy rockets according to claim 1 wherein said columns have inside: first sensors to signal the points reached by said piston in its rising movement and first means operable in response to the signals of said first sensors for closing said shutters of said windows according to a given path; for increasing acceleration; second sensors and second means operable in response to the signals of said second sensors for firing of said solid-propellant motors successively just as each said cluster of solid-propellant motors is left behind by said piston in its rising movement; third sensors to signal the points reached by said piston in its rising movement and third means operable in response to the signals of said third sensors for closing or opening said shutters of said windows according to a given path for allowing a smooth increasing of acceleration; pressure sensors and fourth means operable in response to the signals of said pressure sensors for opening or closing said shutters of said windows according to a given path of pressure and for ensuring said tower against pressures over a computed limit.

* * * * *